US011047155B2

(12) United States Patent
Chen

(10) Patent No.: US 11,047,155 B2
(45) Date of Patent: Jun. 29, 2021

(54) CONCEALED ANTI-TAMPER DEVICE

(71) Applicant: NANNING FUGUI PRECISION INDUSTRIAL CO., LTD., Nanning (CN)

(72) Inventor: Yu-Ting Chen, Hsinchu (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 371 days.

(21) Appl. No.: 16/232,853

(22) Filed: Dec. 26, 2018

(65) Prior Publication Data

US 2020/0208445 A1 Jul. 2, 2020

(51) Int. Cl.

| | |
|---|---|
| ***E05C 1/00*** | (2006.01) |
| ***E05B 65/52*** | (2006.01) |
| ***E05B 35/00*** | (2006.01) |
| ***E05B 19/00*** | (2006.01) |

(52) U.S. Cl.

CPC ..... *E05C 1/004* (2013.01); *E05B 19/0047* (2013.01)

(58) Field of Classification Search

CPC .... E05C 1/004; E05B 19/0047; E05B 65/523; E05B 65/52; E05B 35/006; E05B 73/00; E05B 19/00; Y10S 292/11; Y10T 292/1018; Y10T 292/1099; Y10T 292/307; Y10T 292/1026; Y10T 292/1033

USPC ..... 70/158–173; 292/129, 177–179, 182

See application file for complete search history.

(56) References Cited

U.S. PATENT DOCUMENTS 1,137,302 A * 4/1915 Beach ..... E05B 85/24 292/229
1,538,219 A * 5/1925 Shanahan ..... G01F 15/14 70/169
1,560,489 A * 11/1925 Yager ..... E05C 9/046 292/37
2,014,112 A * 9/1935 Mccord ..... E05B 35/06 70/407
3,984,136 A * 10/1976 Bills ..... E05C 1/06 292/182

(Continued)

FOREIGN PATENT DOCUMENTS

CN 1755046 A 4/2006
CN 204990541 U 1/2016

(Continued)

*Primary Examiner* — Lloyd A Gall
(74) *Attorney, Agent, or Firm* — ScienBiziP, P.C.

(57) ABSTRACT

A concealed anti-tamper device to prevent unauthorized opening and tampering with a manufactured product includes a shell, an anti-dismantling structure concealed in the shell, and at least one key. The shell defines a through hole and a slot. The anti-dismantling structure includes anti-dismantling hook module with hook, driving module, and resetting component anti-dismantling hook module. The anti-dismantling hook module is movable within the shell, and when the product is to be locked, the separate key rotates the driving module, which drives the hook of the anti-dismantling hook module to embed in the slot. The key is rotated in the opposite direction to unlock, until the driving module separates from the anti-dismantling hook module, and the resetting component separates the hook from the slot by the restoring force of a spring.

20 Claims, 7 Drawing Sheets

(56) References Cited

U.S. PATENT DOCUMENTS

| | | | | | |
|---|---|---|---|---|---|
| 4,228,746 | A * | 10/1980 | Caton | E05C 9/06 | 109/59 T |
| 4,475,311 | A | 10/1984 | Gibson | | |
| 4,683,735 | A * | 8/1987 | Magrobi | B60K 15/0409 | 70/168 |
| 6,199,414 | B1 * | 3/2001 | Chang | E02D 29/1427 | 292/11 |
| 6,428,061 | B1 * | 8/2002 | Daoud | E05C 5/04 | 292/251 |
| 7,617,706 | B1 * | 11/2009 | Kuo | E05B 65/46 | 292/182 |
| 8,132,435 | B2 * | 3/2012 | Thomas | E05B 67/36 | 70/95 |
| 8,555,684 | B1 * | 10/2013 | Chen | E05B 47/0012 | 70/280 |
| 8,658,927 | B2 | 2/2014 | Mohtasham et al. | | |
| 9,271,410 | B2 | 2/2016 | Lin et al. | | |
| 9,750,148 | B1 | 8/2017 | Huang | | |
| 2002/0148260 | A1 * | 10/2002 | Garguilo | E02D 29/1427 | 70/168 |
| 2006/0021396 | A1 * | 2/2006 | Javaux | E02D 29/1427 | 70/168 |
| 2018/0238088 | A1 * | 8/2018 | Bowles | E05B 1/00 | |

FOREIGN PATENT DOCUMENTS

| | | | |
|---|---|---|---|
| CN | 205104166 | U | 3/2016 |
| CN | 106817861 | A | 6/2017 |
| CN | 107063322 | A | 8/2017 |
| CN | 206616956 | U | 11/2017 |
| TW | 201420858 | A | 6/2014 |
| TW | 201742532 | A | 12/2017 |

* cited by examiner

CONCEALED ANTI-TAMPER DEVICE

FIELD

The subject matter of the application generally relates to a concealed anti-tamper device.

BACKGROUND

A device that prevents dismantling or disassembly of a product installed on the outside of the product renders disassembly difficult if not impossible. Such device can be dead-bolt lock, special screw, and so on. However having such device being installed affects aesthetics of the product, increases cost in sealing against corrosion, and can be damaged by thieves.

Thus, there is room for improvement in the art.

BRIEF DESCRIPTION OF THE DRAWINGS

Implementations of the present technology will now be described, by way of example only, with reference to the attached figures.

DETAILED DESCRIPTION

Figure 1:
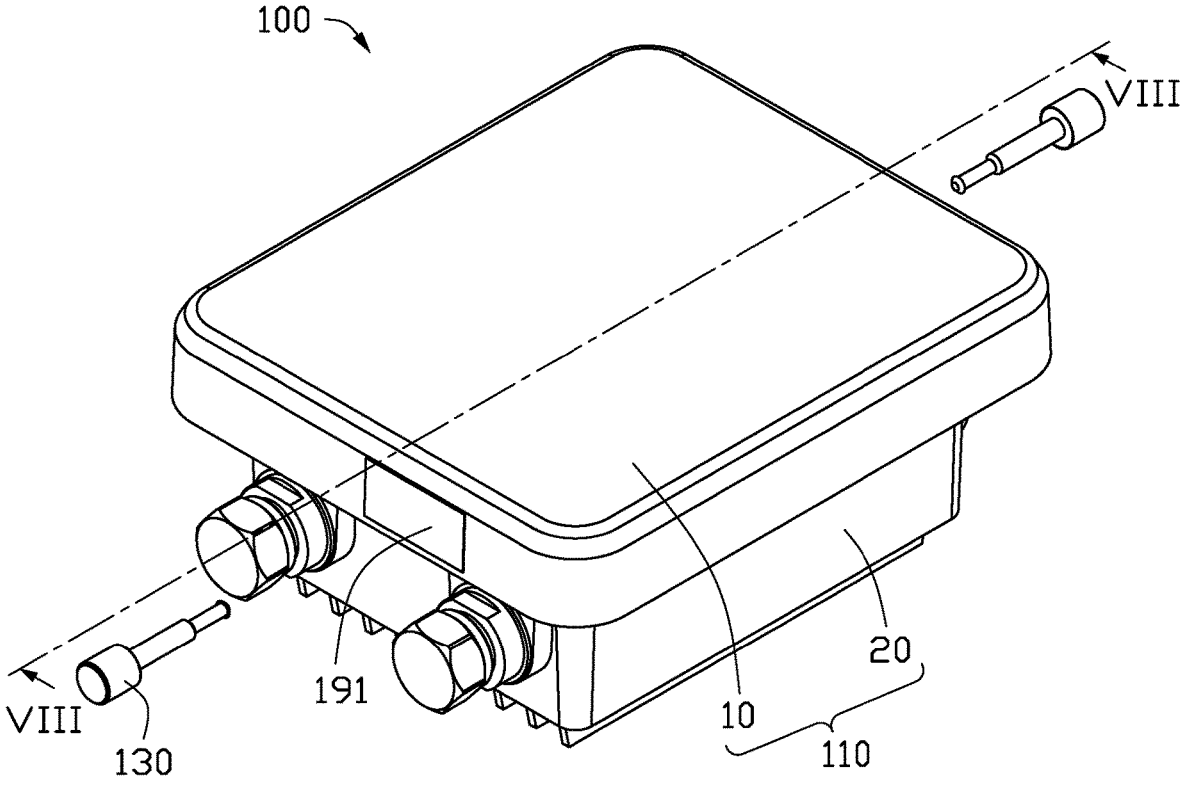
FIG. 1 is a perspective view of an embodiment of a concealed anti-tamper device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain portions may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to", it specifically indicates open-ended inclusion or membership in the so-described combination, group, series, and the like.

FIGS. 1-9 show embodiments of a concealed anti-tamper device 100. The concealed anti-tamper device 100 includes a shell 110, an anti-dismantling structure 120, and a key 130. The anti-dismantling structure 120 is received in the shell 110. The key 130 is coordinated with the anti-dismantling structure 120 to allow unlocking and locking of the anti-dismantling structure 120 and the shell 110.

FIG. 1 shows, the shell 110 including an upper lid 10 and a bottom lid 20 fixed on the upper lid 10 by the anti-dismantling structure 120.

Figure 2:
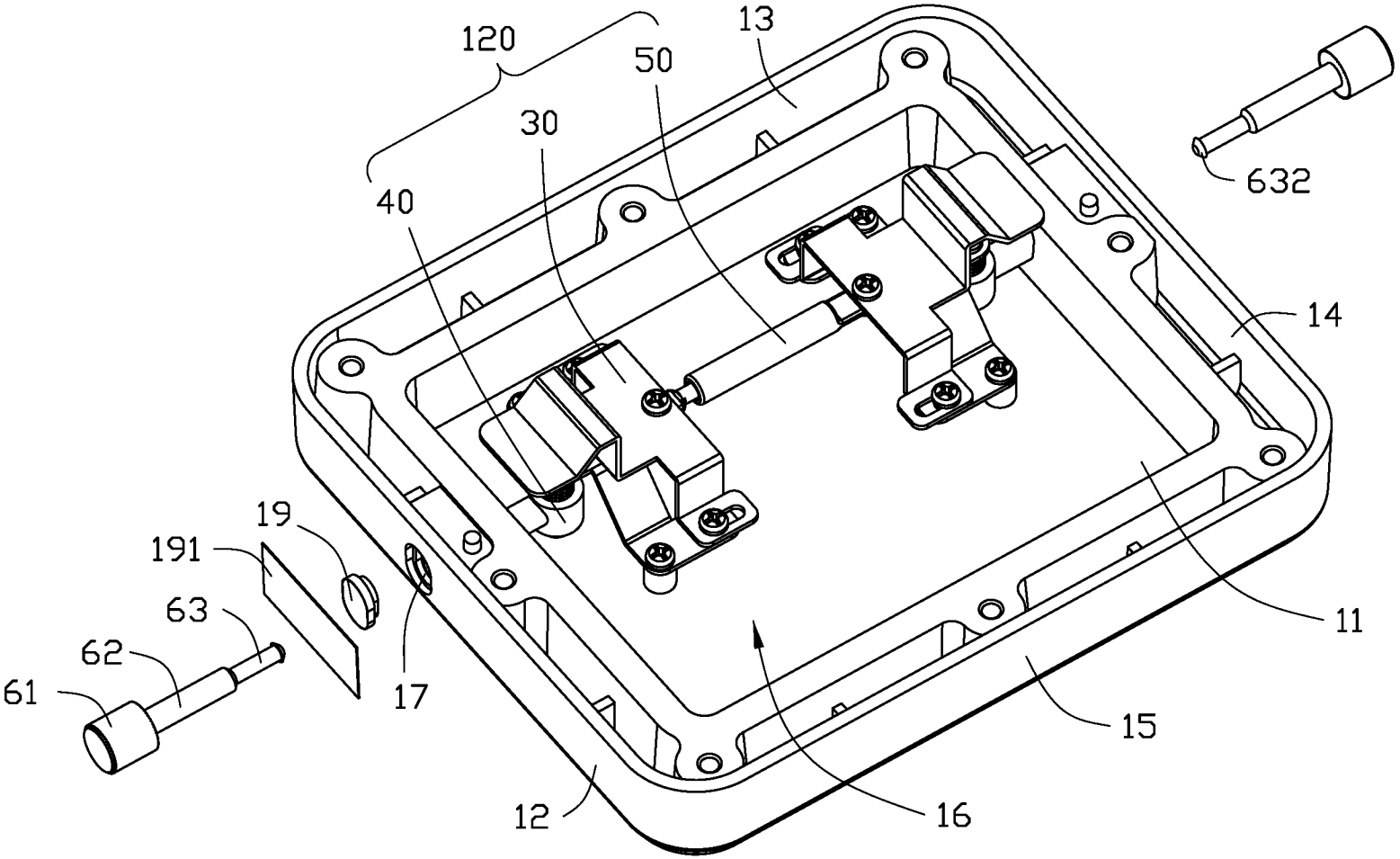
FIG. 2 is a perspective view of the concealed anti-tamper device with the lower cover of FIG. 1 removed.

FIG. 2 shows, the upper lid 10 including a bottom wall 11, a first side wall 12, a second side wall 13, a third side wall 14, and a fourth side wall 15. The first side wall 12, the second side wall 13, the third side wall 14, and the fourth side wall 15 are formed on the bottom wall 11. The first side wall 12 is connected to the second side wall 13, the second side wall 13 is connected to the third side wall 14, the third side wall 14 is connected to the fourth side wall 15, and the fourth side wall 15 is connected to the first side wall 12. The first side wall 12 is opposite to the third side wall 14. The second side wall 13 is opposite to the fourth side wall 15. A first receiving groove 16 is defined by the bottom wall 11, the first side wall 12, the second side wall 13, the third side wall 14, and the fourth side wall 15. The first receiving groove 16 receives and fixes the anti-dismantling structure 120.

In at least one embodiment, the first side wall 12, the second side wall 13, the third side wall 14, and the fourth side wall 15 are perpendicularly formed on the bottom wall 11. The first side wall 12 is perpendicularly connected to the second side wall 13, the second side wall 13 is perpendicularly connected to the third side wall 14, the third side wall 14 is perpendicularly connected to the fourth side wall 15, and the fourth side wall 15 is perpendicularly connected to the first side wall 12.

In other embodiments, the first side wall 12, the second side wall 13, the third side wall 14, and the fourth side wall 15 also can be connected to each other with smoothly curved corners or to form an acute or obtuse angle there between.

In at least one embodiment, the bottom wall 11 is square shaped.

In other embodiment, the bottom wall 11 may be circular, oval, or polygonal.

In at least one embodiment, the bottom wall 11, the first side wall 12, the second side wall 13, the third side wall 14, and the fourth side wall 15 are integrally formed.

The upper lid 10 defines at least one through hole 17. The at least one through hole 17 is defined on at least one of the first side wall 12, the second side wall 13, the third side wall 14, and the fourth side wall 15. The at least one through hole 17 runs through the least one of the first side wall 12, the second side wall 13, the third side wall 14, and the fourth side wall 15. That is, the at least one through hole 17 is connected to the first receiving groove 16.

In at least one embodiment, the upper lid 10 includes two through holes 17 defined at the first side wall 12 and the third side wall 14. The two through holes 17 are opposite to each other.

In other embodiments, the upper lid 10 can include only one through hole 17 when one end of the upper lid 10 is connected to the bottom lid 20.

Figure 3:
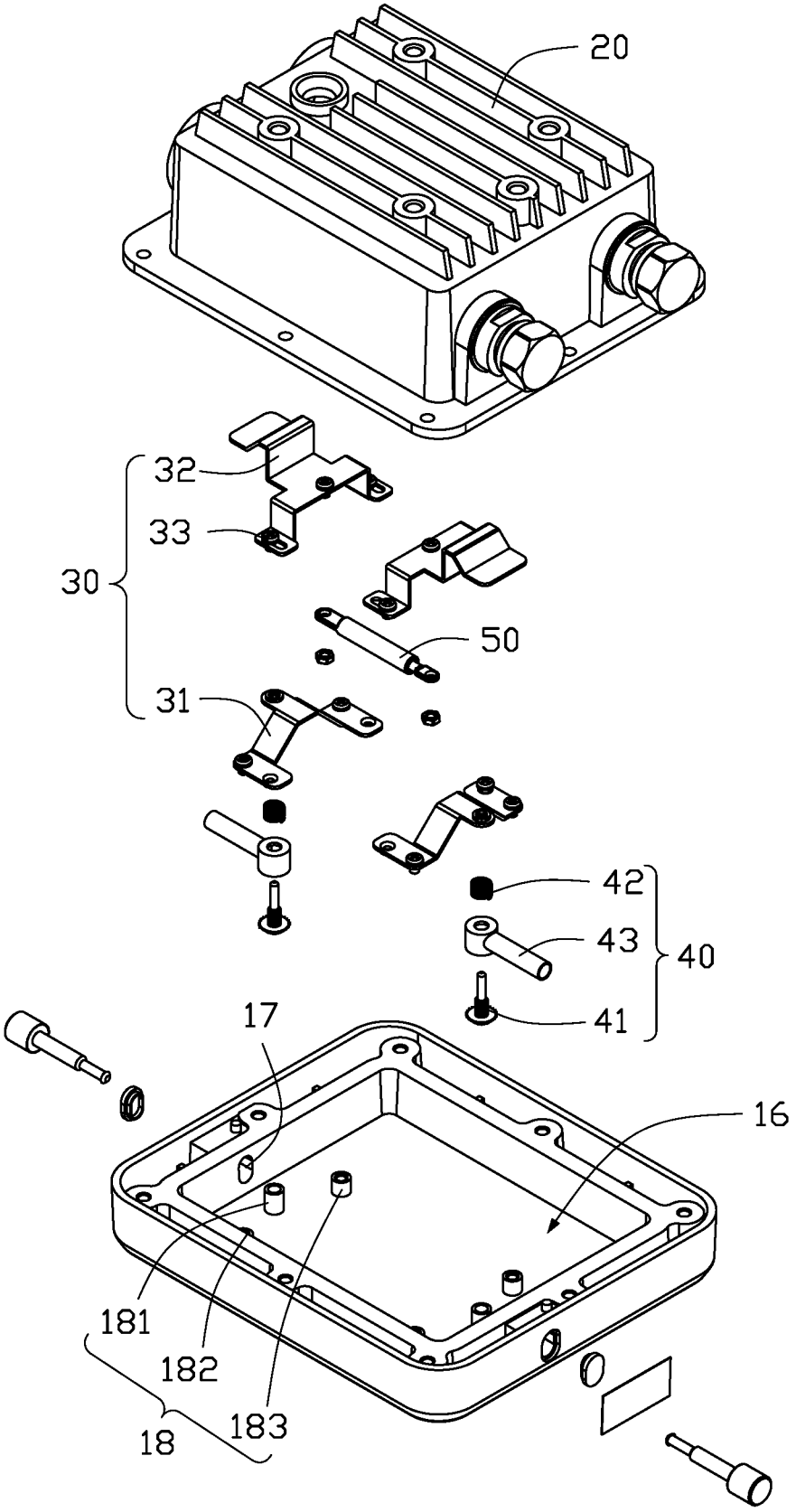
FIG. 3 is an exploded view of the concealed anti-tamper device of FIG. 1.

In FIG. 3, the upper lid 10 further includes at least one registration mast group 18 defined on the bottom wall 11 and received in the first receiving groove 16. Each registration mast group 18 corresponds to one of the two through holes 17.

In at least one embodiment, the upper lid 10 includes two registration mast groups 18.

Each registration mast group 18 includes a first registration mast 181, a second registration mast 182, and a third registration mast 183. The first registration mast 181 is opposite to the through hole 17.

In at least one embodiment, the first registration mast 181, the second registration mast 182, and the third registration mast 183 are arranged in a triangle. The first registration mast 181 is provided nearest to the through hole 17.

The upper lid 10 further includes at least one hole lid 19 matched with the through hole 17 to hide the through hole 17. An exposed surface of the at least one hole lid 19 is flush with an exposed surface of the first side wall 12.

In at least one embodiment, the upper lid 10 includes two hole lids 19. The two hole lids 19 correspond to the two through holes 17.

The upper lid 10 further includes at least one label 191 or other cover stuck on the exposed surface of the at least one hole lid 19 to hide the at least one hole lid 19.

Figure 8:
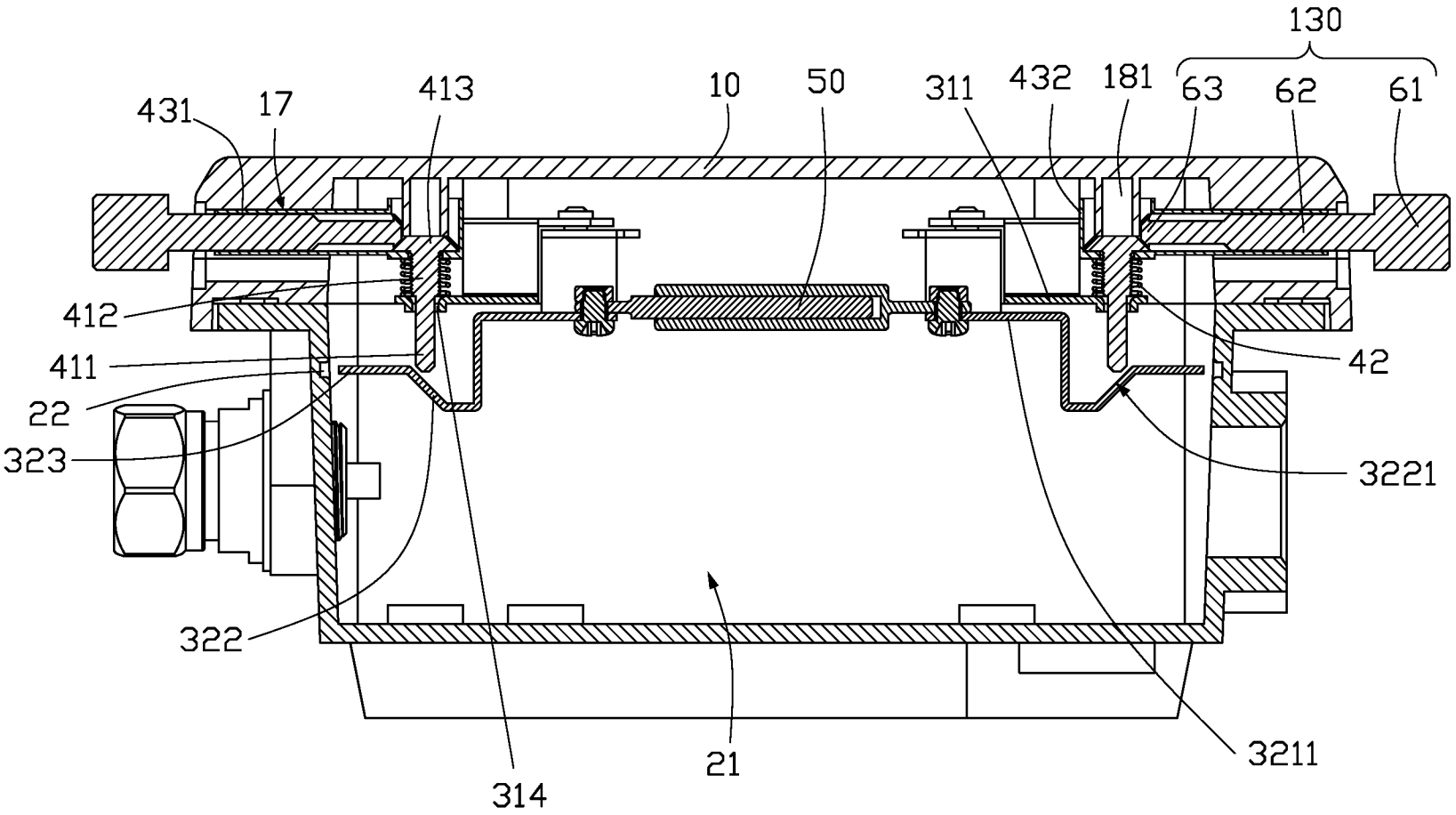
FIG. 8 is a cross-sectional view along line VIII-VIII of FIG. 1 when the concealed anti-tamper device is unlocked.

FIG. 8 shows, the bottom lid 20 including a second receiving groove 21. At least one slot 22 is defined in the bottom lid 20 and connected to the second receiving groove 21 for receiving the hook 323 of the anti-dismantling structure 120 in FIG. 3.

In at least one embodiment, the bottom lid 20 includes two slots 22 corresponding to the two through holes 17.

In FIGS. 2-7, the anti-dismantling structure 120 includes at least one anti-dismantling hook module 30, at least one driving module 40, and at least one resetting component 50.

In at least one embodiment, the anti-dismantling structure 120 includes two anti-dismantling hook modules 30, two driving modules 40, and a resetting component 50.

Each anti-dismantling hook module 30 includes a substrate 31 formed on the bottom wall 11, a hook subassembly 32 movably connected to the substrate 31, and a plurality of locating pins 33.

In at least one embodiment, the substrate 31 is fixed on the bottom wall 11 by two locating pins 33. The hook subassembly 32 is movably connected to the substrate 31 by two locating pins 33.

Figure 4:
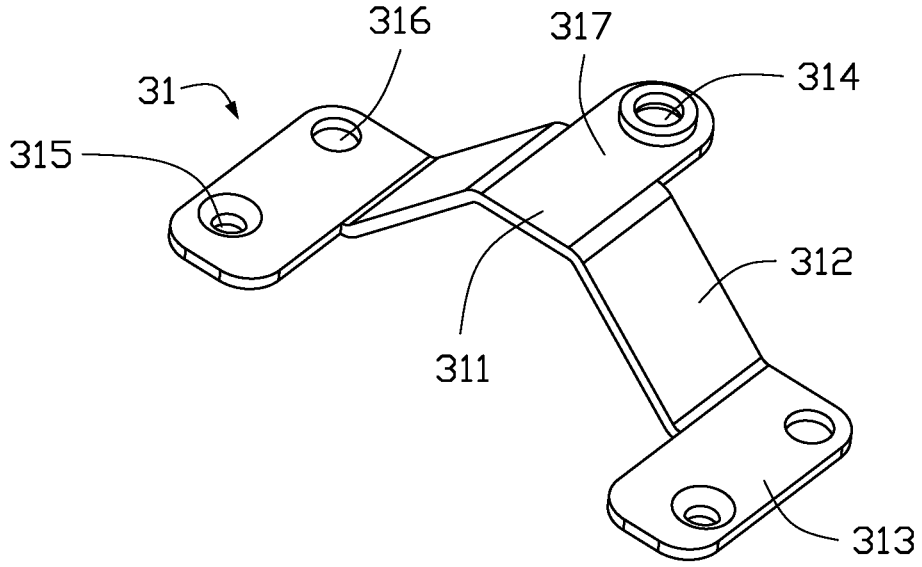
FIG. 4 is a view of a base of the concealed anti-tamper device of FIG. 3.

FIG. 4 shows an arched substrate 31. The substrate 31 includes a first limit portion 311, two first connection portions 312, two first fixing portions 313, and an extending portion 317. The two first connection portions 312 are bent downwards on the opposite ends of the first limit portion 311. The two first fixing portions 313 are bent on two ends of the two first connection portions 312 positioned away from the first limit portion 311. The two first fixing portions 313 are positioned away from the first limit portion 311. The extending portion 317 extends outwards from one end of the first limit portion 311. The expression "bent downwards" means bent from the bottom lid 20 to the upper lid 10.

In at least one embodiment, an obtuse angle is formed between the two first connection portions 312 and the two first fixing portions 313. An obtuse angle is formed between the two first connection portions 312 and the first limit portion 311.

In at least one embodiment, the first limit portion 311, the two first connection portions 312, and the two first fixing portions 313 are integrally formed.

A threaded hole 314 is defined on the extending portion 317. The threaded hole 314 runs through the extending portion 317. The threaded hole 314 corresponds to the first registration mast 181.

A first locating hole 315 and a second locating hole 316 are defined on each first fixing portion 313. The first locating hole 315 and the second locating hole 316 run through the first fixing portion 313. The second locating hole 316 is provided closer to the thread hole 314 than the first locating hole 315. The second locating holes 316 are opposite to the second registration mast 182 and the third registration mast 183. Two locating pins 33 run through the two second locating holes 316 and are fixed in the second registration mast 182 and the third registration mast 183 to fix a first fixing portion 313 to the upper lid 10.

Figure 5:
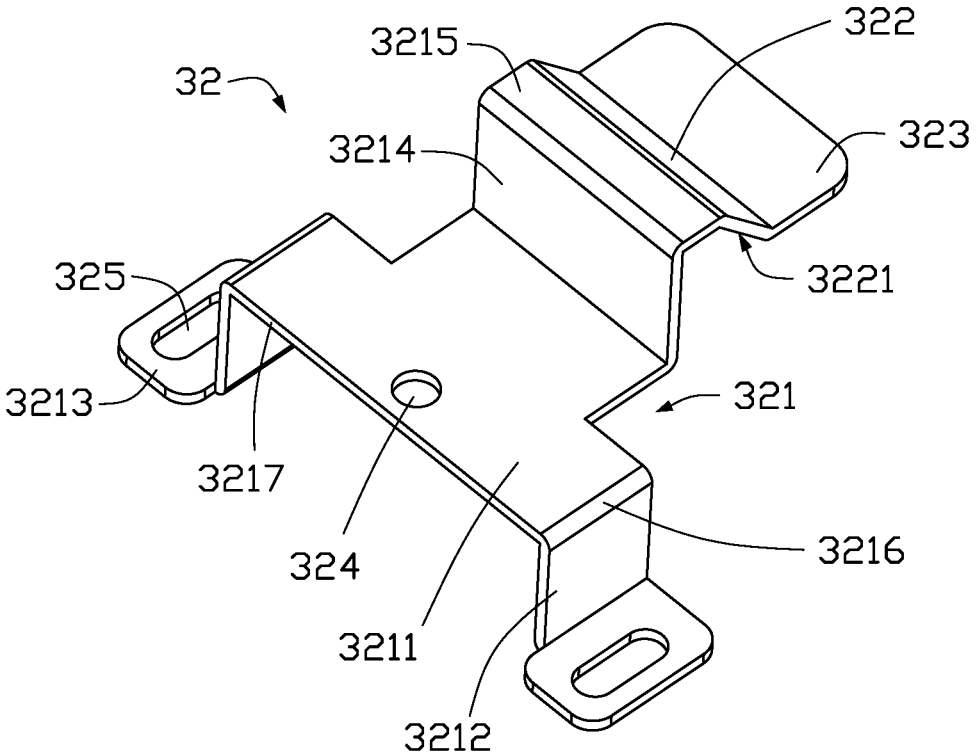
FIG. 5 is a view of a bevel hook of the concealed anti-tamper device of FIG. 3.

FIGS. 5 and 8 show, the hook subassembly 32 including a connecting portion 321, a gradient portion 322, and a hook 323. The gradient portion 322 is connected to the connecting portion 321 and the hook 323. The connecting portion 321 is movably connected to the substrate 31. The gradient portion 322 includes a gradient surface 3221. An obtuse angle is defined by the gradient surface 3221 and the hook 323. The hook 323 corresponds to the slot 22.

The connecting portion 321 includes a second fixing portion 3211, two second connection portions 3212, two second limit portions 3213, a third connection portion 3214, and a transitional portion 3215. The second fixing portion 3211 includes two opposite ends 3216 and two opposite laterals 3217 connecting the two opposite ends 3216. The two second connection portions 3212 are bent downwards from the two opposite ends 3216 of the second fixing portion 3211. The two second limit portions 3213 are bent from ends of the two second connection portions 3212 to extend away from the second fixing portion 3211. The third connection portion 3214 is bent upwards from one of the two opposite laterals 3217. The transitional portion 3215 is bent from one end of the third connection portion 3214 away from the second fixing portion 3211. The transitional portion 3215 is positioned away from the second fixing portion 3211. The gradient portion 322 is bent downwards from one end of the transitional portion 3215 away from the third connection portion 3214. The hook 323 is bent from one end of the gradient portion 322 away from the transitional portion 3215. The hook 323 is positioned away from the transitional portion 3215. The expression "bent upwards" here means bent from the upper lid 10 to the bottom lid 20.

The second fixing portion 3211 is provided parallel to the bottom wall 11. The two second connection portions 3212 are perpendicular to the second fixing portion 3211. The two second limit portions 3213 are positioned perpendicular to the two second connection portions 3212. The third connection portion 3214 is positioned perpendicular to the second fixing portion 3211. The transitional portion 3215 is positioned perpendicular to the third connection portion 3214. An obtuse angle is formed between the gradient portion 322 and the transitional portion 3215. The hook 323 is positioned parallel to the transitional portion 3215.

In at least one embodiment, the second fixing portion 3211, the two second connection portions 3212, the two second limit portions 3213, the third connection portion 3214, the transitional portion 3215, the gradient portion 322, and the hook 323 are integrally formed.

A third locating hole 324 is defined at the second fixing portion 3211 for fixing the resetting component 50 by means of locating pins 33. The third locating hole 324 runs through the second fixing portion 3211.

A long slotted hole 325 is defined in each second limit portion 3213. The long slotted holes 325 run through the two second limit portions 3213. Two locating pins 33 run through the long slotted holes 325 and the first locating holes 315 to fix the second limit portions 3213 on the first fixing portions 313. The long slotted holes 325 and the locating pins 33 limit moving range of the hook subassembly 32 along an X axis direction.

Figure 6:
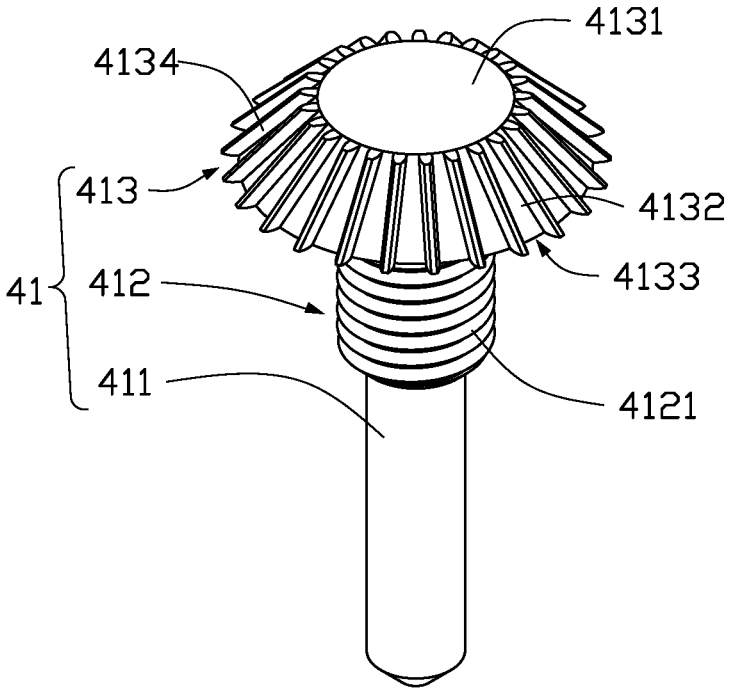
FIG. 6 is a view of a driven gear joint lever of the concealed anti-tamper device of FIG. 3.
Figure 7:
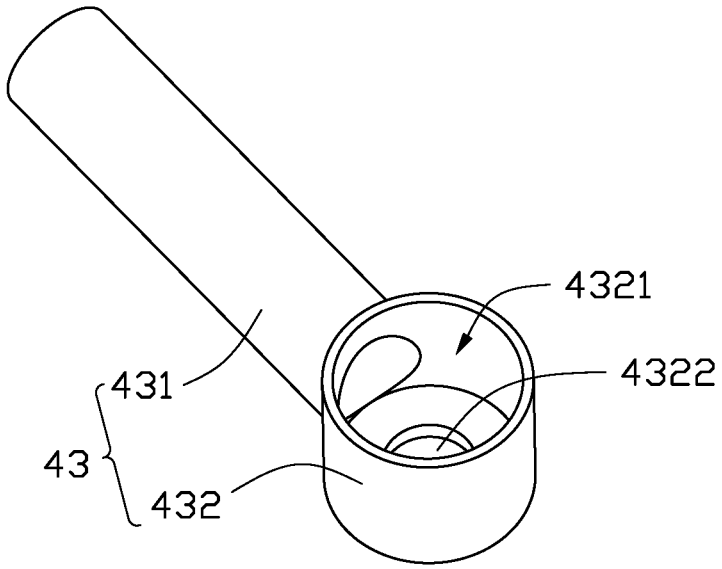
FIG. 7 is a view of a connecting duct of the concealed anti-tamper device of FIG. 3.

FIGS. 3, 6 and 8 show, each of the two driving modules 40 including a driven gear connecting rod 41, an elastic component 42, and a connecting conduit 43.

FIG. 6 shows, the driven gear connecting rod 41 including a top portion 411, a screw thread portion 412, and a driven gear portion 413. The top portion 411 and the driven gear portion 413 connect to opposite ends of the screw thread portion 412. In at least one embodiment, the top portion 411, the screw thread portion 412, and the driven gear portion 413 are integrally formed.

The top portion 411 has a diameter that is less than that of the screw thread portion 412. The screw thread portion 412 has a diameter that is less than that of the driven gear portion 413.

Some screw threads 4121 are defined on outside wall of the screw thread portion 412. The screw threads 4121 of the screw thread portion 412 match with the threaded hole 314. The screw thread portion 412 is fixed in the threaded hole 314 to allow the driven gear connecting rod 41 to push against the top portion 411 or away from the gradient portion 322 to allow locking or unlocking of the anti-dismantling structure 120.

The driven gear portion 413 includes a first surface 4131, an umbrella surface 4132, and a second surface 4133. The second surface 4133 is opposite to the first surface 4131. The umbrella surface 4132 connects the first surface 4131 and the second surface 4133. One end of the screw thread portion 412 positioned away from the top portion 411 is fixed on the second surface 4133. An obtuse angle is defined by the first surface 4131 and the umbrella surface 4132. An acute angle is defined by the umbrella surface 4132 and the second surface 4133. The driven gear portion 413 further includes some driven gears 4134. Each of the driven gears 4134 has a same extending direction as that of the umbrella surface 4132.

The elastic component 42 is set on the screw thread portion 412 of the driven gear connecting rod 41 and is between the driven gear portion 413 and the threaded hole 314. In at least one embodiment, the elastic component 42 is a spring.

The connecting conduit 43 is received and fixed in the through hole 17.

The connecting conduit 43 includes a first conduit portion 431 and a second conduit portion 432. The first conduit portion 431 connects to the second conduit portion 432. The first conduit portion 431 and the second conduit portion 432 are hollow. The first conduit portion 431 is received in the through hole 17. The second conduit portion 432 is received in the first receiving groove 16. The first conduit portion 431 is a channel allowing the key 130 to enter or exit the shell 110.

The second conduit portion 432 includes a first opening 4321 and a second opening 4322 opposite to the first opening 4321.

The first opening 4321 has a diameter that is greater than that of the first registration mast 181. The second opening 4322 has a diameter that is greater than that of the screw thread portion 412 but less than that of the driven gear portion 413. The first registration mast 181 runs through the first opening 4321 and is received in the second conduit portion 432. The driven gear portion 413 is received in the second conduit portion 432 and faces the first conduit portion 431 and the first registration mast 181. The top portion 411, the screw thread portion 412, and the driven gear portion 413 can pass through the second opening 4322. The top portion 411 is opposite to the gradient surface 3221 of the gradient portion 322.

The elastic component 42 lies between the second conduit portion 432 of the connecting conduit 43 and the first limit portion 311 of the substrate 31. The elastic component 42 supports the connecting conduit 43 horizontally.

The connecting conduit 43 may be, but is not limited to, a plastic catheter.

The resetting component 50 is for driving the hook subassembly 32 back to its original position.

In at least one embodiment, two opposite ends of the resetting component 50 are fixed on two of the second fixing portions 3211 of two hook subassemblies 32 by two locating pins 33. The two locating pins 33 run through the third locating hole 324 defined at the second fixing portions 3211 and fixed on the second fixing portions 3211.

In other embodiment, if the anti-dismantling structure 120 just includes an anti-dismantling hook module 30, one end of the resetting component 50 is fixed on the second fixing portion 3211 and the other end of the resetting component 50 is fixed on a side wall that is opposite to the through hole 17.

When the anti-dismantling structure 120 is to be locked, the key 130 drives the driving module 40 to rotate, the driving module 40 drives the hook subassembly 32 to move until the hook 323 is embedded in the slot 22 defined in the second receiving groove 21, and the hook subassembly 32 drives the resetting component 50 to stretch to both sides of the resetting component 50. At this time, the resetting component 50 is stretched.

When the anti-dismantling structure 120 is to be unlocked, the key 130 drives the driving module 40 to rotate in the opposite direction until the top portion 411 separates from the gradient surface 3221, and the resetting component 50 drives the hook subassembly 32 to move until the hook 323 separates from the slot 22 by its restoring force. At this time, the resetting component 50 is back to its original position.

The resetting component 50 may be, but is not limited to, a pneumatic negative pressure rod and a stretchable spring, which stretches under external force and restores to its original state after the external force is removed.

In at least one embodiment, the resetting component 50 is a stretchable spring for reducing cost and increasing working life of the resetting component 50.

As shown in FIG. 6, the key 130 includes a gripping portion 61, an extending portion 62, and a driving gear portion 63. The gripping portion 61 and the driving gear portion 63 are fixed on two opposite ends of the extending portion 62.

In at least one embodiment, the gripping portion 61, the extending portion 62, and the driving gear portion 63 are integrally formed.

Some driving gears 632 are positioned on one end of the driving gear portion 63. The driving gears 632 match with the driven gears 4134.

The key 130 is longer than the first conduit portion 431. The gripping portion 61 has an external diameter that is greater than that of the first conduit portion 431. The extending portion 62 and the driving gear portion 63 all have an external diameter that is less than that of the first conduit portion 431.

In at least one embodiment, the gripping portion 61 has a diameter that is greater than that of the extending portion 62. The extending portion 62 has a diameter that is greater than that of the driving gear portion 63.

When locking or unlocking, the key 130 is received in the connecting conduit 43. The gripping portion 61 protrudes outside the first conduit portion 431, the extending portion 62 is received in the first conduit portion 431, the driving gear portion 63 is received in the second conduit portion 432, and the driving gears 632 touch and match with the driven gears 4134 of the driven gear connecting rod 41.

Figure 9:
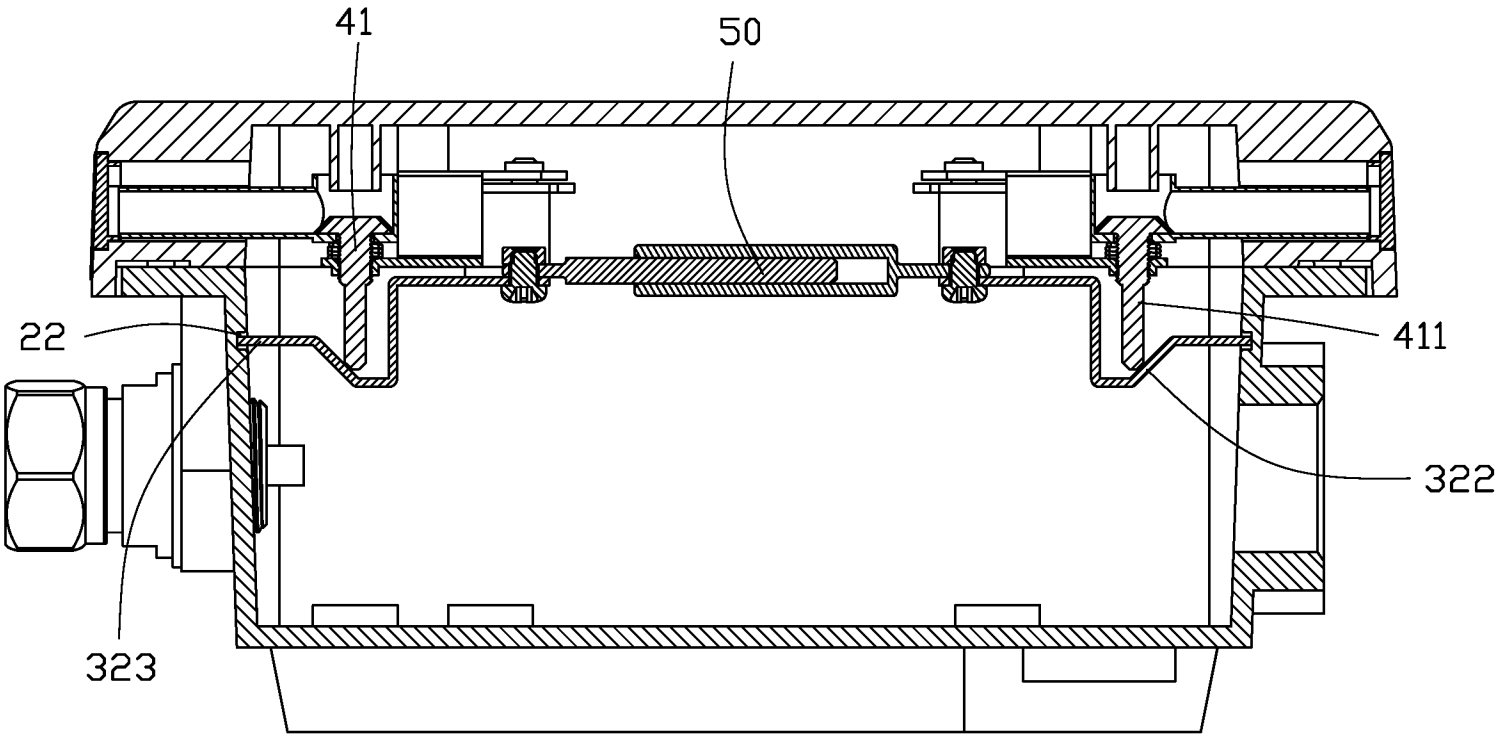
FIG. 9 is a cross-sectional view along line VIII-VIII of FIG. 1 when the concealed anti-tamper device is locked.

FIGS. 8 and 9 show, a locking operation is performed by the key 130 being inserted into the connecting conduit 43, so the driving gears 632 match with the driven gears 4134. Secondly, by rotating the key 130, the key 130 drives the driven gear connecting rod 41 to rotate until the top portion 411 abuts against the gradient surface 3221 of the gradient portion 322. The driven gear connecting rod 41 drives the hook subassembly 32 to move to the slot 22 until the hook 323 is embedded into the slot 22. At this time, the anti-dismantling structure 120 is locked. When unlocking, the key 130 drives the driving module 40 to rotate in the opposite direction until the top portion 411 separates from the gradient surface 3221, and the resetting component 50 drives the hook subassembly 32 to move until the hook 323 is separated from the slot 22 by its restoring force. At this time, the resetting component 50 is back to its original position, and the anti-dismantling structure 120 is unlocked.

With the embodiments described above, the anti-dismantling structure 120 is fixed in the shell 110, the concealed anti-tamper device 100 utilizes the anti-dismantling structure 120 (that is, the driving modules 40 and the resetting component 50) to bear against the inclined surface (that is, the substrate 31 and the hook subassembly 32) to achieve concealment. The concealed anti-tamper device 100 conceals the anti-dismantling structure 120 concealed in the shell 110 which not only saves space but does not affect the original appearance. Also, the concealed anti-tamper device 100 is better protected against brute force attacks and a better resistance against corrosion. The concealed anti-tamper device 100 also has a lower cost and a longer service life. The requirement for the key 130 further increases security, as the key 130 matches with the driving modules 40 to realize locking or unlocking, to separate authorized and unauthorized personnel. The anti-dismantling structure 120 is entirely concealed in the shell to deter casual intruders.

The embodiments shown and described above are only examples. Many details are often found in the art such as the other features of a concealed anti-tamper device. Therefore, many such details are neither shown nor described. Even though numerous characteristics and advantages of the present technology have been positioned forth in the foregoing description, together with details of the structure and function of the present disclosure, the disclosure is illustrative only, and changes can be made in the detail, including in matters of shape, size, and arrangement of the parts within the principles of the present disclosure, up to and including the full extent established by the broad general meaning of the terms used in the claims. It will therefore be appreciated that the embodiments described above can be modified within the scope of the claims.

What is claimed is:

1. A concealed anti-tamper device, comprising:

a shell, the shell defining a through hole and a slot;

an anti-dismantling structure concealed in the shell, the anti-dismantling structure comprising:

at least one anti-dismantling hook module, the anti-dismantling hook module comprising a hook opposite to the slot;

at least one driving module opposite to the anti-dismantling hook module, the anti-dismantling hook module is movably connected to the shell; and at least one resetting component fixed on the anti-dismantling hook module; and at least one key matching with the driving module, wherein when locking, the key is inserted into the shell and drives the driving module to rotate, the driving module drives the anti-dismantling hook module to move until the hook is embedded in the slot; when unlocking, the key drives the driving module to rotate in the opposite direction until the driving module separating from the anti-dismantling hook module, and the resetting component drives the anti-dismantling hook module to move until the hook separating from the slot by its restoring force.

2. The concealed anti-tamper device of claim 1, wherein the shell comprises an upper lid, the upper lid comprises a bottom wall, a first side wall, a second side wall, a third side wall, and a fourth side wall, the first side wall, the second side wall, the third side wall, and the fourth side wall are formed on the bottom wall and define a first receiving groove, the through hole defines in at least one of the first side wall, the second side wall, the third side wall, and the fourth side wall, the through hole connects to the first receiving groove, the anti-dismantling hook module is received in the first receiving groove.

3. The concealed anti-tamper device of claim 2, wherein the anti-dismantling hook module comprises a substrate formed on the bottom wall; a threaded hole is defined in the substrate, the driving module comprises a driven gear connecting rod, the driven gear connecting rod comprises a screw thread portion, the driven gear connecting rod passes through the threaded hole, and the screw thread portion is fixed in the threaded hole by threaded connection.

4. The concealed anti-tamper device of claim 3, wherein the substrate is roughly arched, the substrate comprises a first limit portion, two first connection portions, two first fixing portions, and an extending portion; the two first connection portions are bent downwards from two opposite ends of the first limit portion, the two first fixing portions are bent from two ends of the two first connection portions away from the first limit portion, the two first fixing portions are away from the first limit portion, the extending portion extends outwards from one end of the first limit portion; the two first fixing portions are fixed on the bottom wall; the threaded hole is defined on the extending portion.

5. The concealed anti-tamper device of claim 4, wherein an obtuse angle is defined by the two first connection portions and the two first fixing portions.

6. The concealed anti-tamper device of claim 4, wherein an obtuse angle is formed between the two first connection portions and the first limit portion.

7. The concealed anti-tamper device of claim 4, wherein the upper lid further comprises at least one registration mast group defined on the bottom wall and received in the first receiving groove, the registration mast group comprises a first registration mast corresponding to the through hole and the threaded hole.

8. The concealed anti-tamper device of claim 7, wherein the anti-dismantling hook module further comprises a hook subassembly, the hook subassembly further comprises a connecting portion and a gradient portion, the gradient portion is connected to the connecting portion and the hook, the connecting portion is movably connected to the two first fixing portions; the gradient portion comprises a gradient surface, the driven gear connecting rod is opposite to the gradient surface.

9. The concealed anti-tamper device of claim 8, wherein the connecting portion comprises a second fixing portion, two second connection portions, two second limit portions, a third connection portion, and a transitional portion; the two second connection portions are bent downwards from two opposite ends of the second fixing portion, the two second limit portions are bent from ends of the two second connection portions to extend away from the second fixing portion, the third connection portion is bent upwards from connecting portion, the transitional portion is bent from one end of the third connection portion away from the second fixing portion; the two second limit portions are movably connected to the two first fixing portions; the gradient portion connects to the transitional portion.

10. The concealed anti-tamper device of claim 8, wherein an obtuse angle is formed between the gradient surface and the hook.

11. The concealed anti-tamper device of claim 9, wherein an obtuse angle is formed between the gradient portion and the transitional portion.

12. The concealed anti-tamper device of claim 8, wherein the driven gear connecting rod further comprises a top portion, the top portion connects to the screw thread portion, the top portion is opposite to the gradient surface.

13. The concealed anti-tamper device of claim 8, wherein the driven gear connecting rod further comprises a driven gear portion connecting to the screw thread portion, the driven gear portion further comprises some driven gears, the key comprises a driving gear portion, the driving gear portion comprises some driving gears, the driving gears match with the driven gears.

14. The concealed anti-tamper device of claim 13, wherein the driving module further comprises an elastic component, the elastic component is set on the screw thread portion and is between the driven gear portion and the threaded hole.

15. The concealed anti-tamper device of claim 14, wherein the elastic component is a spring.

16. The concealed anti-tamper device of claim 13, wherein the driving module further comprises a connecting conduit, the connecting conduit comprises a first conduit portion received and fixed in the through hole and a second conduit portion connecting to the first conduit portion, the second conduit portion is received in the first receiving groove, the second conduit portion comprises a first opening and a second opening opposite to the first opening, the first registration mast is received in the second conduit portion, the driven gear portion is received in the second conduit portion and faces the first conduit portion and the first registration mast.

17. The concealed anti-tamper device of claim 9, wherein when the concealed anti-tamper device comprises two anti-dismantling hook modules, two opposite ends of the resetting component are fixed on two of the second fixing portions of two hook subassemblies.

18. The concealed anti-tamper device of claim 9, wherein when the concealed anti-tamper device comprises an anti-dismantling hook module, one end of the resetting component is fixed on the second fixing portion and the other end of the resetting component is fixed on a side wall that is opposite to the through hole.

19. The concealed anti-tamper device of claim 1, wherein the resetting component is a pneumatic negative pressure rod or a stretching spring.

20. The concealed anti-tamper device of claim 1, wherein the shell further comprises a bottom lid fixed on an upper lid, the slot is defined in the bottom lid.

* * * * *